United States Patent [19]

Shaw

[11] Patent Number: 4,998,567

[45] Date of Patent: Mar. 12, 1991

[54] WEFT THREAD BREAK DETECTOR WITH A TIME DELAY CIRCUIT

[75] Inventor: Henry Shaw, Vleteren, Belgium

[73] Assignee: Picanol, N.V., Belgium

[21] Appl. No.: 446,152

[22] Filed: Dec. 5, 1989

[30] Foreign Application Priority Data

Dec. 5, 1988 [BE] Belgium ..... 08801361

[51] Int. Cl.[5] ..... D03D 47/34; D03D 51/34

[52] U.S. Cl. ..... 139/116.2; 139/370.2; 139/452

[58] Field of Search ..... 139/116.2, 452, 370.2

[56] References Cited

U.S. PATENT DOCUMENTS 4,815,502 3/1982 Takegawa ..... 139/452
4,832,091 5/1989 Shaw ..... 139/452 X

FOREIGN PATENT DOCUMENTS 0292044 5/1988 European Pat. Off. .
0195469 3/1989 European Pat. Off. .

*Primary Examiner*—Andrew M. Falik
*Attorney, Agent, or Firm*—Bacon & Thomas

[57] ABSTRACT

An airjet weaving machine with a weft thread supply includes a plurality of yarn packages, thread preparation mechanisms, and thread blocking devices on the thread preparation mechanisms. A thread break detector is mounted between the yarn packages and the thread blocking devices. Upon detection of a thread break, a control unit deactivates the thread preparation mechanism in which the thread break has occurred, and thread removal devices are subsequently activated a pre-determined time interval after detection of the thread break so that at least a weft thread section into the main nozzle is removed in order to prevent the broken off piece of weft thread from becoming entangled with other weft threads and thus being blown together with the other weft threads into the shed, or to prevent the broken off piece from blocking other main nozzles.

16 Claims, 3 Drawing Sheets

1
2
3
5
5
26
25

26
5
6
18
44
21
2
10
8
9
20
19
41
4
22
10B
III
16
24
43
37
17
39
40
3
11
10A
42
38
28
23
12
13
14
15
25
27

WEFT THREAD BREAK DETECTOR WITH A TIME DELAY CIRCUIT

BACKGROUND OF THE INVENTION

This invention concerns an airjet weaving machine with an improved supply for the weft threads.

It is known that the supply for weft threads on an airjet weaving machine normally consists of several thread preparation mechanisms, each made up of at least one yarn package, a thread accumulator such as for example a prewinder device, a thread blocking mechanism in order to release suitable lengths of weft thread from the prewinder device, and a main nozzle.

It is clear that the different thread preparation mechanisms can operate with different weft threads, for example in order to weave with several colours.

From Belgian patent No. 901.969 it is known for the thread preparation mechanism to be duplicated. For each thread preparation mechanism there is a thread detector connected to a control unit, such that whenever a broken weft thread is detected in a thread preparation mechanism, the system switches over automatically to the other thread preparation mechanism, so that weaving can continue without interruption.

The main nozzle of the deactivated thread preparation mechanism, however, remains activated, normally at a low rate of flow, so that the length of weft thread between the thread blocking mechanism and the main nozzle remains taut. If this were not the case, the length of weft thread would fall out of the main nozzle and become entangled in the other weft threads.

Whenever a thread preparation mechanism is placed on standby, the weaver must intervene in order to repair the defective supply channel. However, it may happen that the above-mentioned length of weft thread has to wait too long in a main nozzle. The main nozzle is normally mounted on the sley of the weaving machine, and thus carries out a back-and-forth movement, with the result that the length of weft thread extending into the main nozzle is heavily stressed and can break.

If the length of weft thread breaks close to the main nozzle placed on standby, the piece of thread which comes loose may be blown into the shed along with a weft thread from another main nozzle, giving rise to a weaving fault which can greatly reduce the quality of the cloth.

If the above-mentioned weft thread breaks close to the thread accumulator, there is a great chance of the broken-off piece of thread becoming entangled with the other weft threads, and thus either being blown together with them into the shed via another main nozzle or blocking the other main nozzles. In the latter case a weaving machine stop occurs which can last relatively long, since the weaver is usually not in a position to attend to the stoppage immediately.

SUMMARY OF THE INVENTION

The invention aims to provide a solution to the above-mentioned disadvantages, by among other things ensuring when a thread break occurs, that a signal is given to the weaver and that the signal is followed after a certain time by a partly or fully automatic thread removal of any length of weft thread extending into the main nozzle.

The time interval thus provided enables the weaver to intervene quickly, while in the extreme case, namely at the end of the time interval, the removal of the length of weft thread prevents a weaving fault from occurring as a result of a loose piece of thread being blown into the shed.

The invention also concerns an airjet weaving machine with the characteristic that its supply includes at least two thread preparation mechanisms, each made up of at least one yarn package, a thread accumulator mechanism, a thread blocking device and a main nozzle, and; detection means to sense thread breaks. The detection means operates on at least one of the weft threads and is mounted between the corresponding yarn package and the corresponding thread blocking device. A control unit is connected to the detection means and the thread preparation mechanisms such that when the detection means senses a thread break, the control unit deactivates the thread preparation mechanism in which the thread break has occurred and transfers its task to another thread preparation mechanism. A control device is also connected to the detection means and includes of at least a time delay circuit which produces an output signal for further processing after a certain time from the moment that the detection means senses a thread break. Finally, thread removal means which can be activated by the output signal and which can remove at least the weft thread section extending into the main nozzle are connected to the time delay circuit.

The airjet weaving machine is preferably equipped with a signalling device which is activated as soon as the above-mentioned detection means senses a thread break.

Preferably, other thread detectors are located near to the main nozzles, in order to monitor the presence of the weft threads. Whenever a break occurs prematurely in the weft thread on a main nozzle on standby, so that a piece of thread escapes and gets into the shed, the corresponding thread detector—which does not detect a thread any more—gives a signal, with the result that the main drive of the weaving machine is immediately shut down.

BRIEF DESCRIPTION OF THE DRAWINGS

In order to better explain the characteristics of the invention, the following preferred embodiment is described, by way of example only and without being limitative in any way, with reference to the accompanying drawings, where.

DESCRIPTION OF THE PREFERRED EMBODIMENTS

Figure 1:
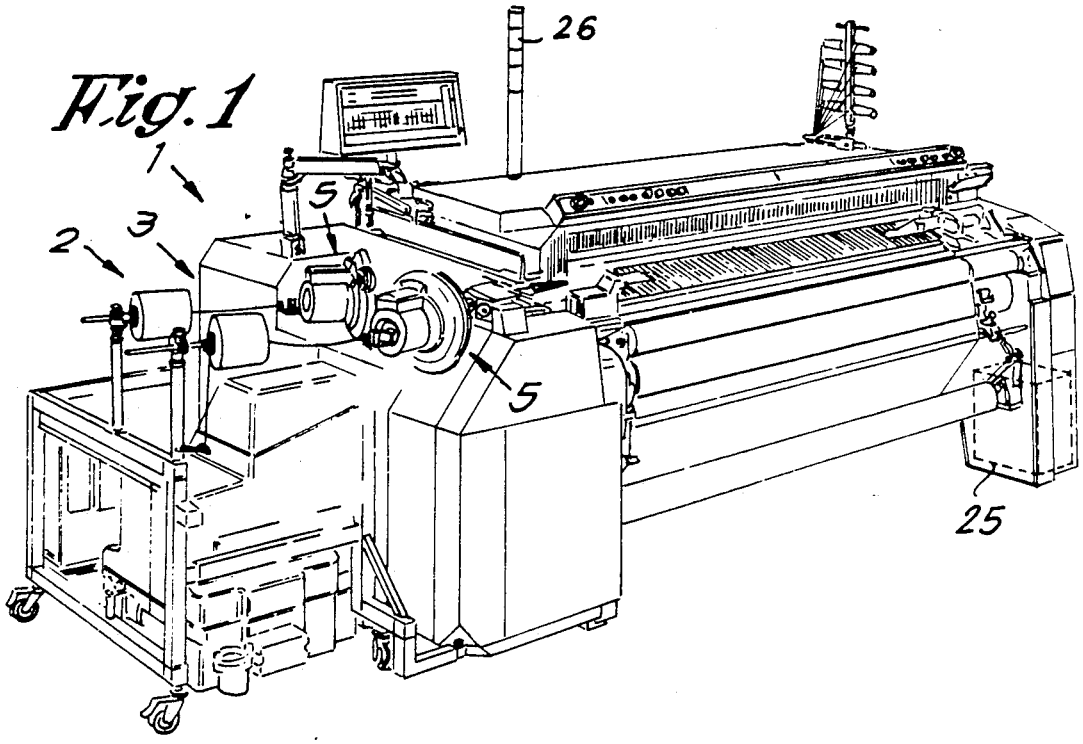
FIG. 1 is a perspective view of an airjet weaving machine with a weft thread supply according to the invention.

FIG. 1 shows an airjet weaving machine, in which the supply 1 according to the invention is shown schematically.

Figure 2:
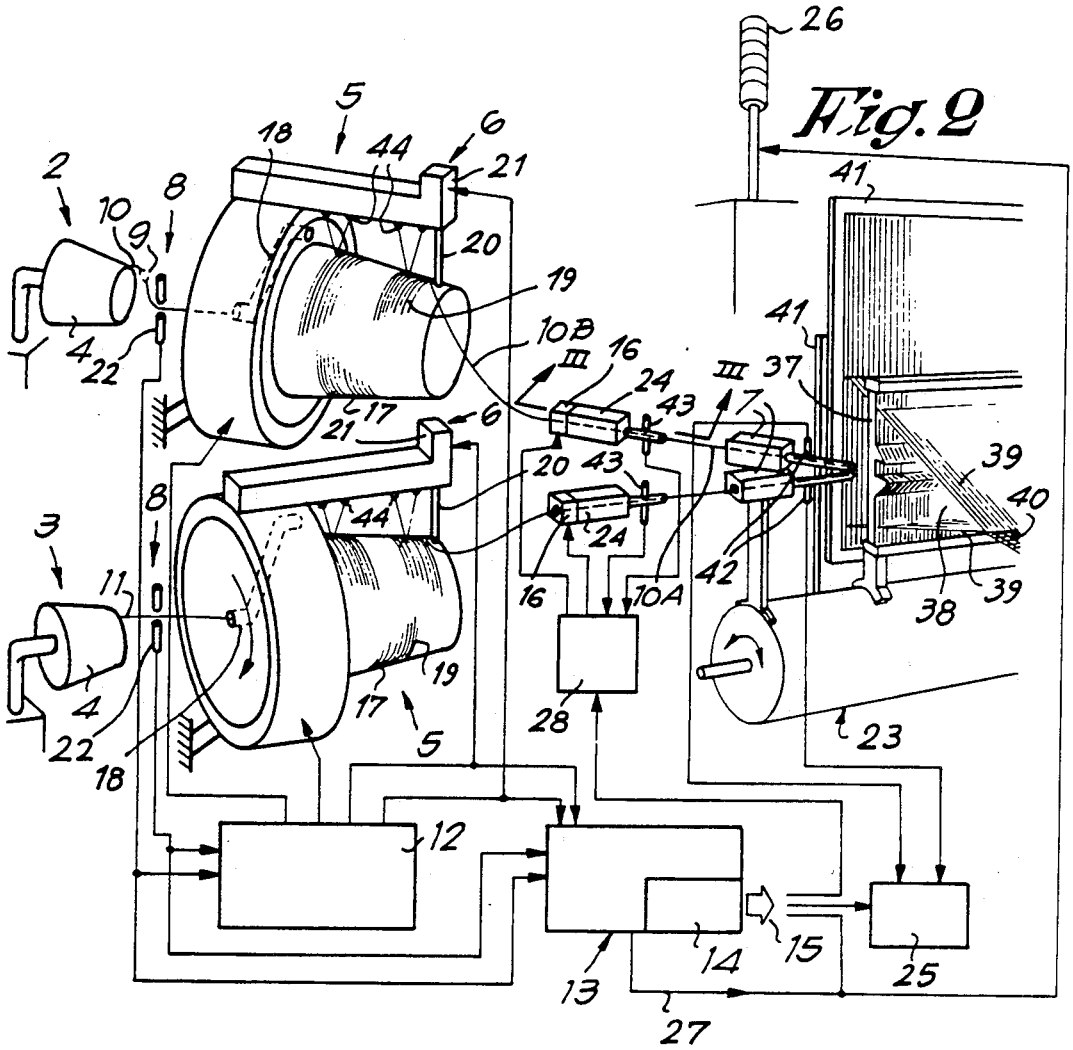
FIG. 2 is a schematic diagram of the supply of weft threads according to the invention.

As shown in FIG. 2, the supply 1 includes at least two thread preparation mechanisms 2 and 3, each composed of at least one yarn package 4, a thread accumulator mechanism such as a prewinder device 5, a thread blocking device 6 and a main nozzle 7.

The supply 1 according to the invention further includes a detection means 8 for sensing thread breaks 9. The detection means operates on at least one of the weft threads 10 and/or 11 of the respective yarn packages 4. A control unit 12 is connected to the detection means 8 and to the thread preparation mechanisms 2 and 3, more specifically the prewinder device 5, such that when the detection means 8 senses a thread break 9, said control unit deactivates the thread preparation mechanism in which the thread break 9 has occurred, and transfers its task to other thread preparation mechanisms. A control device 13 is also connected to the detection means 8, and includes at least a time delay circuit 14 which provides an output signal 15 for further processing a certain time after the detection means 8 has sensed a thread break 9. Connected to time delay circuit 14 is a thread removal means 16 which can be activated by the output signal 15 and which can remove at least the weft thread section of the weft thread 10 extending into the main nozzle 7.

In the embodiment according to FIG. 2, the prewinder devices 5 respectively include a fixed prewinder drum 17 and a rotating winding tube 18 which lays turns 19 on the prewinder drum 17.

The thread blocking devices 6 each includes in the known way, a pin 20 which moves up and down. Pin 20 operates on the corresponding prewinder drum 17 and is moved by means of a solenoid 21.

The detection means 8 includes thread break detectors 22 mounted in the paths of the weft threads 10 and 11, in particular between the yarn packages 4 and the respective thread blocking devices 6. The most suitable position is at the entrance to the winding tubes 18.

The above-mentioned main nozzles 7 are normally mounted on the sley 23, and carry out a back-and-forth movement. Auxiliary main nozzles 24 may or may not be placed in the paths of the weft threads 10 and 11.

The control device 13 is connected via the time delay circuit 14 to thread removal means 16 and possibly to the main drive 25 of the weaving machine and a signalling device 26, which includes, for example, a number of lamps. There is also a direct connection 27 between the signalling device 26 and the control device 13.

A thread removal device 16 mounted in the paths of the weft threads 10 and 11 makes it possible to draw the sections of weft thread extending into the main nozzles 7, for example the section 10A located between the main nozzle 7 and the corresponding auxiliary main nozzle 24, out of the respective main nozzles 7 and to grip them separately. Thread removal devices 16 are controlled by a control unit 28, which in turn is controlled by the output signal 15 of the time delay circuit 14. Such thread removal devices 16 can for example be mounted at the entrances to the auxiliary main nozzle 24, as is shown in FIG. 2.

Figure 3:
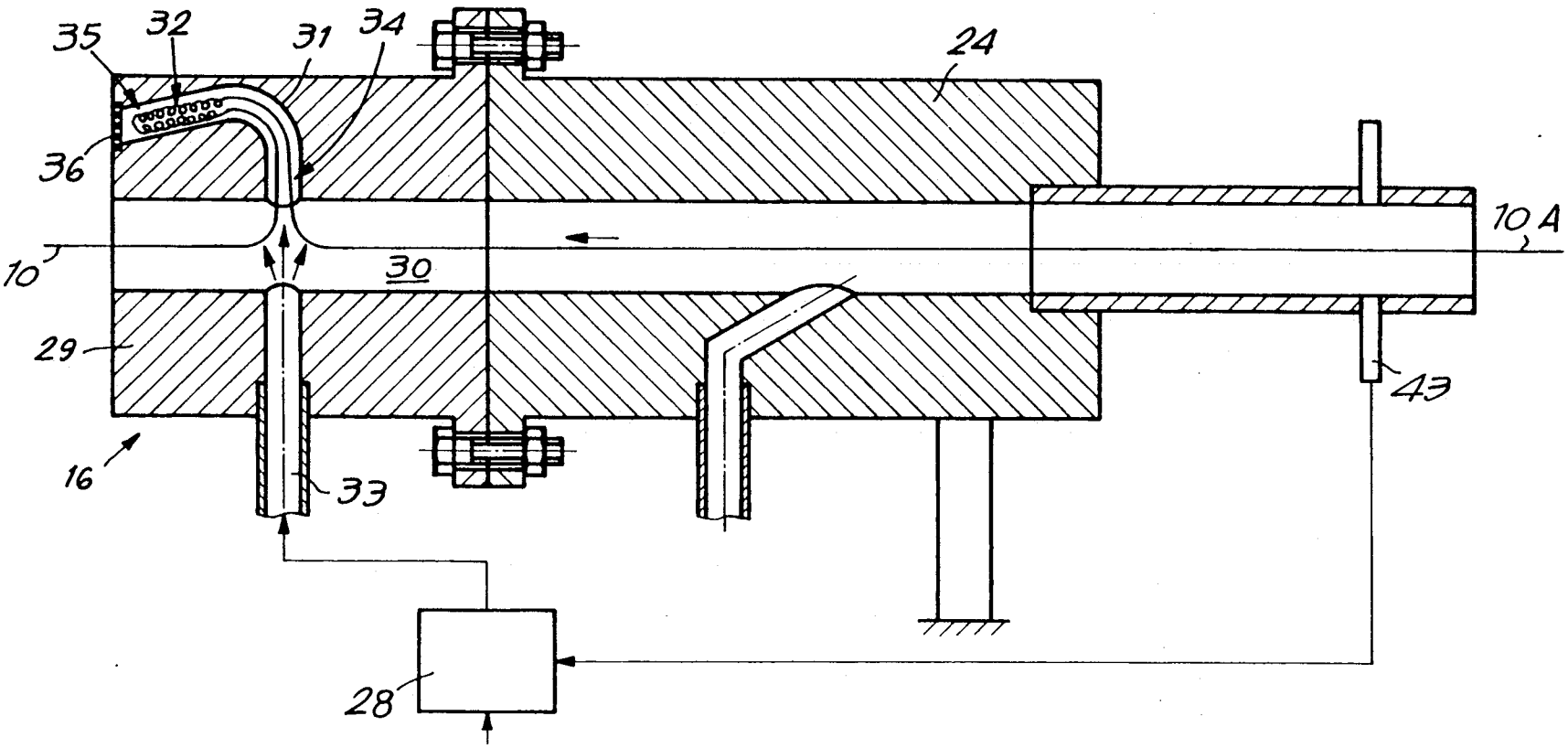
FIG. 3 is a cross-section along line III—III in FIG. 2, to a greater scale.

As shown in greater detail in FIG. 3, the thread removal devices 16 include, for example, a body 29 with a thread guide channel 30, a holder 31 for storing a quantity of thread 32 and a nozzle 33, controlled by the control unit 28, which can blow the section of weft thread 10A into the holder 31. The holder 31 includes, for example, a channel with one end 34 opening perpendicular to the thread guide channel 30, and with the other end 35 communicating with the environment and closed by a sieve-like element 36 which prevents the passage of thread but allows air to escape.

The channel of the holder 31 is curved so that the section of weft thread 10A remains caught in the holder 31 after it has been blown into said holder 31.

For the sake of clarity, also shown in FIG. 2 are the reed 37, the shed 38, the warp threads 39, the cloth 40 and the harnesses 41.

Finally, where possible, detectors 42 can be mounted at the output side of the thread preparation mechanisms 2 and 3. These detectors preferably work in conjunction with the thread guide tubes of the main nozzles 7, or are mounted just after the exits of the main nozzles 7. If detectors 42 do not detect one of the weft threads 10 and/or 11, they supply a signal, with the result that the main drive 25 is shut down. The detectors 42 can either be connected directly to the main drive 25, as shown in FIG. 2, or they can be connected indirectly to it, for example via the control device 13.

The operation of the supply according to FIG. 2 is now described for a thread break 9 which has occurred in the weft thread 10. The thread break detector 22 of the thread preparation mechanism 2 senses this thread break. As a result of this, the control unit 12 is activated, such that the thread preparation mechanism 2 is deactivated and its task taken over by the thread preparation mechanism 3. In order to achieve this, the drive of the winding tube 18 of the prewinder device 5 of the thread preparation mechanism 2 is stopped, while the corresponding pin 20 is kept in the closed position.

The main nozzle 7 of the thread preparation mechanism 2, however, remains activated at a low flow rate, such that the section of weft thread 10B between the main nozzle 7 and the corresponding thread blocking device 6 remains taut. As a result of the back-and-forth movement of main nozzle 7, and as a result of the tension force continually exerted on the weft thread 10, the section of weft thread 10B will normally break off after a certain length of time, with the chance it will either be woven in or become entangled in the other weft thread 11.

In order to prevent that a part of the thread section 10 held taut by the main nozzle 7 from breaking off and causing and cause faults, the control device 13 is activated according to the present invention from the moment that the thread break 9 is detected, such that an output signal 15 is supplied by the time delay circuit 14 after a certain time. The control device 28 is activated by the output signal 15, with the result that the thread removal device 16 which operates on the thread 10 is activated such that this thread, or at least the section 10A which extends into the corresponding main nozzle 7, is blown into the holder 31 by means of the nozzle 33, as shown in FIG. 3. Since the quantity of thread 32 lodges in the curved holder 31, a tension force is no longer required in order to hold the weft thread in front of the thread removal device 16, and the piece of thread removed cannot form and obstruction to subsequent weft threads 11 being inserted.

There can also be a detector 43 in the auxiliary main nozzle 24 in order to determine whether the corresponding section of weft thread 10A between the auxiliary main nozzle 24 and the main nozzle 7 has been completely removed. This detector 43 can be connected to the control unit 28, such that whenever it does not detect a thread any more, the nozzle 33 of the corresponding thread removal device 16 is deactivated.

In a preferred embodiment, at the moment a thread break 9 is detected, a flashing lamp is activated on the signalling device 26 via the connection 27, so that the lamp goes slowly on and off. When, however, the preset interval has elapsed on the time delay circuit 14, the lamp is activated continuously by means of the output signal 15. The lamp can for example flash progressively faster, according to the elapsed interval of the time delay.

The time delay is preferably adjustable. The time delay to be set is preferably chosen by trial and error, by determining the period after which thread breaks normally occur. This will of course depend on the quality and the type of weft yarn used.

The minimum time delay used for this purpose before activating the thread removal device 16, is the time necessary to switch from thread preparation mechanism 2 to thread preparation mechanism 3 after a signal has been given by the detector 22. The maximum time delay must not be greater than the period after which there is a real chance of the corresponding section of weft thread 10B breaking.

Preferably, a time interval is used which permits manual intervention on the part of the weaver before the automatic thread removal device 16 is activated. In that case, clearly the main nozzle 7 concerned is still threaded, so there is no need to rethread the main nozzle 7. The weaver only has to repair the thread break 9.

In the case where the weaver cannot be in a position to attend to a repair quickly enough and the time interval has elapsed, the section of thread between the auxiliary main nozzle 24 and the main nozzle 7 is taken up into the holder 31. Here it should be noted that the auxiliary main nozzle can be rethreaded simply by energizing it, as a result of which the thread 10A is drawn out of the holder 31. Clearly however, it will be necessary to rethread the corresponding main nozzle 7.

It also clear that rethreading the corresponding main nozzle 7 does not necessarily have to be done via the thread preparation mechanism 2 in which the thread break 9 has occurred, but can also be done via another thread preparation mechanism which contains weft thread of the same type and also includes a yarn package, a thread accumulator mechanism and a thread blocking device.

When determining the time delay to be set, the moment at which the other weft threads are inserted, for instance weft thread 11, is preferably taken into account. Care should be taken among other things to remove the section of weft thread 10A between the auxiliary main nozzle 24 and the main nozzle 7 at a moment when no weft thread is being inserted. This ensures that while the thread is being removed there is only a minimal chance of it becoming entangled with one of the other weft threads being inserted, or being blown simultaneously into the shed along with the other weft thread via another main nozzle, or blocking another main nozzle. In order to achieve this, the signal supplied by the control unit 12 to the solenoid 21 of the pin 20 can for example also be supplied to the control device 13, such that the output signal 15 is only supplied when no weft thread is being inserted.

In a variant, after a first time delay in order to activate the thread removal device 16, the main drive 25 of the weaving machine is shut down automatically. Shortly thereafter, a second output signal 15 is supplied, in order to activate the thread removal device 16. Since thread removal is carried out during a machine stop, the above-mentioned problems cannot occur while thread removal is being carried out. Once the detector 43 does not sense a thread any more, the thread removal device 16 is deactivated and the weaving machine is started automatically once more.

During each of the above steps, a suitable lamp on the signalling device 26 can of course be lit, so that the weaver is informed of each step of the cycle.

For practical reasons, the duration of the time delay is usually chosen so that it is only a fraction of the time after which the weakest weft threads could possibly break.

It may happen that coincidentally there is a piece in the section of weft thread 10B of the main nozzle on standby, between the pin 20 and the corresponding main nozzle 7, which is weaker than the average strength of the thread. In this special case, there is a large chance of the section of weft thread 10B breaking between the pin 20 and the main nozzle 7 before the set time interval has elapsed, with the result that a weaving fault will arise unnoticed by the weaver.

In order to be able to intervene in case of such a fault, use is preferably made of the above-mentioned detectors 42. Whenever an unexpected thread break of this type occurs prematurely, the main drive 25 is immediately shut down. The weaver must then repair the fault and restart the weaving machine. In such a case a separately recognizable signal can be given, so that the weaver first repairs this machine and restarts it, with the aim of having as few weaving machines down as possible in the weaving mill. When the thread removal device 16 is activated, the detectors 42 are deactivated.

This invention enables a great number of weaving faults to be avoided, so obtaining a significantly better quality of cloth.

As a result of the built-in time delay, the total down time of the weaving machine is kept to a minimum, so that within the given time interval, the weaver himself can choose at what moment to briefly shut down the weaving machine and carry out a repair.

Finally, it should be noted that the detection means 8 can also include one of the winding detectors 44.

It is clear that the use of the auxiliary main nozzles 24 is not indispensable. The thread removal means 16 can also be mounted at other points in the paths of the weft threads 10 and 11.

The present invention is not limited to the embodiment described by way of example and shown in the drawings; on the contrary, such a weaving machine, and more particularly the supply thereof, can be made in various forms, while still remaining within the scope of the invention.

I claim:

1. A weft thread supply for an airjet weaving machine, comprising:

a plurality of thread preparation mechanisms each of which performs the task of thread preparation and includes at least one yarn package, a thread accumulator mechanism, a thread blocking device, and means including a main nozzle for inserting weft thread into a shed of the weaving machine;

detection means for sensing thread breaks in at least one weft thread, said detection means being mounted between corresponding yarn packages and thread blocking devices of said at least two thread preparation mechanisms;

a control unit connected to the detection means and the thread preparation mechanisms which includes means for deactivating one of said thread preparation mechanisms and transfering its task to another of said thread preparation mechanisms;

a control device connected to the detection means, said device including time delay circuit means for supplying an output signal for further processing at a predetermined time interval after the detection means has sensed a thread break;

and thread removal means connected to the time delay circuit means and activated by the output signal for removing at least a section of weft thread extending into the main nozzle.

2. A weft thread supply as claimed in claim 1 wherein said time delay circuit means includes means for supplying said output signal at a moment when no weft thread is being inserted by said main nozzle into the shed of the weaving machine.

3. A weft thread supply as claimed in claim 1, wherein said time delay circuit means is connected to signaling means for signaling an operator of the machine from at least the moment when said output signal is supplied thereto by said delay circuit means.

4. A weft thread supply as claimed in claim 1, wherein said time delay circuit means is connected to a main drive of the weaving machine and to said removal means, and wherein said time delay circuit means includes means for shutting down the main drive after said output signal is received, means for activating said removal means a predetermined time after said output signal is received, and means for, after the section of weft thread extending into the main nozzle has been removed, deactivating the removal means and starting the main drive of the weaving machine.

5. A weft thread supply as claimed in claim 3, wherein said control device includes a direct connection to said signaling means and means for activating said signaling means as soon as said detection means has sensed a thread break.

6. A weft thread supply as claimed in claim 1, further comprising signaling means for supplying various signals to an operator of the machine, and means for activating said signaling means progressively as the time interval of said time delay circuit means elapses.

7. A weft thread supply as claimed in claim 1, wherein each of said thread accumulation mechanisms includes a respective prewinder drum and winding tube, and wherein said detection means includes a thread break detector mounted at an entrance of at least one of said winding tubes.

8. A weft thread supply as claimed in claim 1 further comprising additional detection means mounted near to exit ends of the thread preparation mechanisms for sensing the absence of a weft thread before said removal means is activated, and means for shutting down, before the removal means is activated, the main drive of the weaving machine in response to sensing by the detection means of the absence of a weft thread.

9. A weft thread supply as claimed in claim 8, wherein said additional detection means is mounted in an exit of at least one of said main nozzles.

10. A weft thread supply as claimed in claim 1, wherein said removal means is mounted between said thread accumulator mechanism and said main nozzle.

11. A weft thread supply as claimed in claim 10, wherein each of said thread preparation mechanisms forms a weft thread path from a yarn package to a respective main nozzle, said supply further comprising auxiliary main nozzles mounted in each of the weft thread paths, and wherein said thread removal means are mounted at entrances of the respective auxiliary main nozzles.

12. A weft thread supply as claimed in claim 10, wherein said removal means comprises a body provided with a thread guide channel, a channel-shaped holder, and means including a nozzle for blowing a thread out of the thread guide channel into the holder.

13. A weft thread supply as claimed in claim 12, wherein the holder includes a channel with one end opening perpendicular onto the thread guide channel and another end opening onto the environment.

14. A weft thread supply as claimed in claim 13, wherein said holder is closed by a sieve-shaped element at said end opening onto the environment.

15. A weft thread supply as claimed in claim 12, wherein said holder includes a curved channel.

16. A weft thread supply as claimed in claim 1, further comprising additional detection means for sensing the presence of weft thread between said thread removal means and said main nozzles and means for deactivating said removal means when the presence of weft thread is not sensed.

* * * * *